United States Patent [19]

Kasanami et al.

[11] Patent Number: 4,693,843

[45] Date of Patent: Sep. 15, 1987

[54] RESISTANCE PASTE

[75] Inventors: Toru Kasanami, Kyoto; Hiroji Tani, Nagaokakyo; Shizuharu Watanabe, Kyoto; Toshiaki Ikeda, Ishikawa, all of Japan

[73] Assignee: Murata Manufacturing Co., Ltd., Japan

[21] Appl. No.: 838,250

[22] Filed: Mar. 10, 1986

[30] Foreign Application Priority Data

Mar. 12, 1985 [JP] Japan ..... 60-50184

[51] Int. Cl.[4] ..... H01B 1/06

[52] U.S. Cl. ..... 252/518; 252/519; 106/1.22; 106/1.24; 106/1.28

[58] Field of Search ..... 252/518, 519; 106/1.22, 106/1.24, 1.25, 1.28

[56] References Cited

U.S. PATENT DOCUMENTS 3,682,840 8/1972 Locin ..... 252/518

*Primary Examiner*—Josephine L. Barr

*Attorney, Agent, or Firm*—Ostrolenk, Faber, Gerb & Soffen

[57] ABSTRACT

Resistance paste for baked-film resistors consists essentially of conducting powder, glass frit and organic varnish. The conducting powder consists essentially of iron oxide, ruthenium oxide and lead oxide, the molar ratio of the three components of the conducting powder being 1:0.6–3:0.2–1 when expressed in terms of $Fe_3O_4$, $RuO_2$ and $Pb_3O_4$, respectively.

4 Claims, No Drawings

RESISTANCE PASTE

FIELD OF THE INVENTION

The present invention relates to resistance paste, and more particularly, to resistance paste for baked-film resistors.

BACKGROUND OF THE INVENTION

Baked-film resistors basically consist of a resistance film formed on an insulating substrate by baking the resistance paste. As a material for producing such resistance films, it has been proposed in various patent specifications and literature to use resistance paste containing, as a conducting component, metal oxides. For example, Japanese patent publication Nos. 27871/1976 and 28162/1980 disclose resistance paste containing $Bi_2O_3$-$RuO_2$ or $Pb_3O_4$-$RuO_2$ as the conducting component. When manufacturing resistors, such resistance paste is applied by screen printing to an insulating substrate such as, for example, an alumina substrate, and baked in air to form a resistance film.

Such a resistance film exhibits a good stability of resistance with voltage, temperature and humidity, but it is poor in resistance to wear caused by sliding contact with a slider, which is mounted on a shaft concentric with a ring having the resistance film thereon. Thus, adjustable film resistors containing metal oxides as a conducting material have a serious wear problem awaiting a solution. For example, their resitance changes by 30 to 50% with respect to its initial value after only 100 times of rotation of the slider. In addition, the resistance paste of the prior art contains a large amount of expensive ruthenium. For example, the resistance paste of the $Bi_2O_3$-$RuO_2$ system contains $RuO_2$ such that a molar ratio of Bi to Ru is 4:5 to 4:8. Thus, it is difficult to cut down the manufacturing cost of the resistors. In the $Pb_3O_4$-$RuO_2$ system, a molar ratio of PbO to $RuO_2$ is 1:1 to 2:1.

SUMMARY OF THE INVENTION

It is therefore an object of the present invention to provide resistance paste which makes it possible to produce baked-film resistors with a high resistance to sliding abrasion in addition to high stability of resistance with voltage, temperature, and humidity.

Another object of the present invention is to provide a resistance paste which can be produced at a low cost.

According to the present invention, these and other objects can be solved by incorporating a specific amount of iron oxide into a prescribed amount of a basic component of $RuO_2$ and $Pb_3O_4$.

DETAILED DESCRIPTION OF EMBODIMENTS OF THE INVENTION

According to the present invention, there is provided resistance paste consisting essentially of conducting powder, a glass frit and an organic varnish, characterized in that said conducting powder consists essentially of iron oxide, ruthenium oxide and lead oxide, the molar ratio of said three components of the conducting powder being 1:0.6–3:0.2–1 when expressed in terms of $Fe_3O_4$, to $RuO_2$ and $Pb_3O_4$, respectively.

The reasons why the molar ratio of three components of the conducting powder has been limited to the above range are as follows. If the molar ratio of $RuO_2$ to $Fe_3O_4$ is less than 0.6:1, the square resistance becomes too large and a temperature coefficient of resistance exceeds ±500 ppm/°C. If the molar ratio of $RuO_2$ to $Fe_3O_4$ is more than 3:1, it is required to use a great amount of $RuO_2$, thus making it impossible to cut down the manufacturing cost of the resistance paste. Thus, the molar ratio of ruthenium oxide to iron oxide has been limited to the value within the range of from 0.6:1 to 3:1 in terms of $RuO_2$ and $Fe_3O_4$, respectively.

If the molar ratio of $Pb_3O_4$ to $Fe_3O_4$ is less than 0.2:1, an added amount of ruthenium oxide must be increased in proportion to the reduced amount of $Pb_3O_4$, thus making it difficult to cut down the manufacturing cost of the resistance paste. If the molar ratio of $Pb_3O_4$ to $Fe_3O_4$ is more than 1:1, the square resistance becomes too large and the temperature coefficient of resistance becomes more than ±500 ppm/°C. Thus, the molar ratio of $Pb_3O_4$ to $Fe_3O_4$ has been limited to the value within the range of from 0.2:1 to 1:1.

As the glass frit, there may be used any of the conventionally known types of glass frit. Typical galss frit is of a lead borosilicate system. Preferably, the solid component of the resistance paste consists essentially of 30 to 70% by weight of glass frit and the remainder of the conducting powder. If the content of the conducting powder is less than 30% by weight, or if the content of the glass frit is more than 70%, the content of the glass frit becomes too much, and the molten glass component flows on electrode surfaces when baking the paste, resulting in soldering defects of the electrodes. If the content of the conducting powder is more than 70%, or if the content of the glass frit is less than 30%, it is difficult to obtain a mechanical strength of the film sufficient for practical use and also the electrical properties of the resistance films are lowered at high temperatures and high humidity.

When the resistance paste is applied to adjustable resistors, it is preferred to use resistance paste comprising a solid component which consists of 50 to 55% by weight of glass frit and 45 to 50% by weight of the conducting powder. If the content of the conducting powder is less than 45% by weight, or if the content of the glass frit is more than 55% by weight, the life characteristic with rotation of the semifixed resistors becomes lowered. If the content of the conducting powder is more than 50% by weight, or if the content of the glass frit is less than 50% by weight, the resistance to humidity becomes lowered.

As stated above, however, if the resistance paste is used to manufacture fixed resistors, particularly, fixed resistors with low resistance, the content of the glass frit in the solid component may vary from 30 to 70% by weight. Since the resistance film is covered with an insulating material, no problem occurs in practical use even if the content of glass frit falls in the range of 30 to 50% by weight.

The organic varnish is added to the solid component composed of the conducting powder and glass frit to prepare resistance paste. Preferably, a content of the varnish in the paste is from 25 to 35% by weight. The content of varnish in the paste has been limited as being in the range of 25 to 35% by weight for the following reasons. If the content of the varnish in the paste is less than 25% by weight, the content of the solid component becomes too much, thus making it impossible to produce resistance paste with good printing properties. The varnish exceeding 35% by weight causes running from printed patterns to be formed, thus making it impossible to form resistance films with a predetermined surface area, resulting in substantial variation in the value of the resistance obtained.

As the organic varnish, there may be used those such as, for example, ethyl cellulose dissolved in α-terpineol.

The resistance paste according to the present invention may be produced in the following manner: Raw materials for the conducting powder, i.e., iron oxide, ruthenium oxide and lead oxide are weighed in a predetermined molar ratio, and then milled together with a suitable amount of water in a pot-mill for a suitable period of time. The mixture is dried and then heat-treated at 600° to 900° C. to prepare the conducting powder. The conducting powder is added with a suitable amount of glass frit and then mixed with a suitable amount of an organic varnish to prepare resistance paste.

The resistance paste according to the present invention may be applied by screen printing to a surface of an insulating substrate and then baked in air at a temperature ranging from 700° to 900° C. to form film resistors basically consisting of a resistance film formed on the insulating substrate. Analysis of the conducting powder prepared by heat-treatment of 700° C. for 2 hours showed that it consists of a mixture of an oxide having a pyrochlore crystal structure of $Pb_2Ru_2O_7$, $Fe_3O_4$ and a complex oxide of Pb and Fe.

The resistance paste according to the present invention makes it possible to manufacture film resistors with a square resistance of up to 1 MΩ/□, a temperature coefficient of resistance of not more than ±500 ppm/°C. and considerably improved resistance to sliding abrasion. Thus, the resistance paste of the invention is useful not only for fixed resistors but also for the semifixed resistors.

EXAMPLE 1

Using powders of $Fe_3O_4$, $RuO_2$ and $Pb_3O_4$ as raw materials for conducting powder, there were prepared mixtures each having a molar ratio shown in Table 1. The mixture of raw materials was milled by the wet process for 24 hours in a pot mill together with a suitable amount of water, heated to evaporate water, placed in an alumina crucible and then heated to 700° C. for 2 hours to prepare conducting powder. The conducting powder was mixed with lead borosilicate glass frit in a ratio shown in Table 1 and then milled with 28% by weight of an organic varnish to prepare resistance paste.

To determine the properties of the paste, it was applied to screen printing to a surface of an alumina substrate to form a resistance film extending between a pair of parallel silver electrodes which had been previously formed on the substrate at a distance of 4 mm by baking at 850° C. for 10 minutes.

The resultant resistors were subjected to measurement of their square resistance, and temperature coefficient of resistance (TCR) at high and low temperatures. The TCR at low temperatures was determined in the temperature range of from −55° to +25° C. (hereinafter referred to as cold TCR) and the TCR at high temperatures was in the temperature range of +25° to +150° C. (hereinafter referred to as hot TCR) in accordance with a method defined in MILL STD 202F Test Method 304. Results are also shown in Table 1.

In Table 1, asterisked specimens indicate resistors prepared by the resistance paste out of the scope of the present invention, while others are those prepared by the resistance paste of the present invention.

TABLE 1

| Specimen No. | Conducting powder (Molar ratio) $Fe_3O_4$ | $RuO_2$ | $Pb_3O_4$ | Conducting powder /glass frit (wt %) | Square Resistance (Ω/□) | Cold T.C.R. (ppm/°C.) | Hot T.C.R (ppm/°C.) |
|---|---|---|---|---|---|---|---|
| 1 | 1 | 3 | 1 | 70/30 | 140 | +266 | +280 |
| 2 | 1 | 3 | 1 | 50/50 | 3.7k | +85 | +177 |
| 3 | 1 | 3 | 1 | 30/70 | 35k | −57 | +58 |
| 4 | 1 | 1.2 | 1 | 70/30 | 3.2k | −25 | +99 |
| 5 | 1 | 1.2 | 1 | 50/50 | 18k | −175 | −68 |
| 6 | 1 | 1.2 | 1 | 30/70 | 187k | −256 | −208 |
| 7 | 1 | 0.6 | 1 | 70/30 | 14k | −188 | +7.7 |
| 8 | 1 | 0.6 | 1 | 50/50 | 131k | −208 | −69 |
| 9 | 1 | 0.6 | 1 | 70/30 | 550k | −242 | −209 |
| 10 | 1 | 1.25 | 0.75 | 50/50 | 8.5k | +43 | +160 |
| 11 | 1 | 1.25 | 0.75 | 40/60 | 15k | +8.9 | +131 |
| 12 | 1 | 1.5 | 0.5 | 50/50 | 5.8k | +213 | +283 |
| 13 | 1 | 1.5 | 0.5 | 45/55 | 9.5k | +182 | +257 |
| 14 | 1 | 1.5 | 0.5 | 40/60 | 25k | +97 | +185 |
| 15 | 1 | 1.5 | 0.25 | 50/50 | 5k | +38 | +136 |
| 16 | 1 | 1.5 | 0.25 | 45/55 | 12k | −45 | +65 |
| 17 | 1 | 1.5 | 0.25 | 40/60 | 22k | −113 | +6.6 |
| 18 | 1 | 0.9 | 0.3 | 50/50 | 76k | +36 | +118 |
| 19 | 1 | 0.9 | 0.2 | 50/50 | 150k | −95 | −15 |
| 20 | 1 | 0.6 | 0.3 | 50/50 | 180k | −390 | −320 |
| 21* | 1 | 0.9 | 0.1 | 50/50 | 2 M | −1800 | −2900 |
| 22* | 1 | 0.6 | 0.2 | 50/50 | 8.6 M | −525 | −3050 |
| 23* | 1 | 0.6 | 0.1 | 50/50 | $4 \times 10^{10}$ | — | — |
| 24* | 1 | 0.3 | 0.3 | 50/50 | $4 \times 10^{9}$ | — | — |

EXAMPLE 2

Resistance paste was prepared in the same manner as in Example 1 so that it has the same composition that the paste Nos. 12, 13, 14, 15, 16 or 17 in that example has.

The resistance paste was then applied in a ring-shaped form to a surface of an alumina substrate and baked at 850° C. for 10 minutes to prepared a resistance film for slide type semifixed resistor.

A slider was mounted on a shaft concentric with the ring so that a suitable sliding contact can be obtained between them. The resistance of the resistor was measured before and after 100 times of rotation of the slider to determine change rate of resitance. The results are shown in Table 2.

TABLE 2

| Specimen No. | change rate of resistance (%) |
|---|---|
| 12 | +0.85 |
| 13 | −4.2 |
| 14 | −40.4 |
| 15 | −1.3 |
| 16 | −1.9 |
| 17 | −9.4 |

As can be seen from the results shown in Table 2, the semifixed resistors prepared by the resistance paste containing 50 to 55% of glass frit exhibit high resistance to sliding abrasion, while those preferably the resistance paste Nos. 14 and 17 containing 60% by weight of glass frit shows considerable change rate of resistance. Thus, it is preferred for the manufacture of semifixed resistors to use resistance paste containing 50 to 55% by weight of glass frit.

The resistance paste according to the present invention makes it possible to manufacture resistors with a square resitance of 1 MΩ/□ at the maximum and a temperature coefficient of resistance of ±500 ppm/°C. Also, the resistance paste makes it possible to manufacture semifixed resistors with high resistance to sliding abrasion.

What I claim is:

1. Resistance paste consisting essentially of conducting powder, glass frit and organic varnish, characterized in that said conducting powder consists essentially of iron oxide, ruthenium oxide and lead oxide, the molar ratio of said three components of the conducting powder being substantially 1:0.6–3:0.2–1 when expressed in terms of $Fe_3O_4$, $RuO_2$ and $Pb_3O_4$, respectively.

2. The resistance paste according to claim 1 wherein a solid component consists essentially of substantially 30 to 70% by weight of conducting powder and substantially 30 to 70% by weight of glass frit.

3. The resistance paste according to claim 1 wherein the paste consists essentially of substantially 65 to 75% by weight of a solid component, said solid component consisting essentially of conducting powder and glass frit, and substantially 25 to 35% by weight of the organic varnish.

4. The resistance paste according to claim 2 wherein the solid component consists essentially of substantially 45 to 50 percent by weight of conducting powder and 50 to 55 percent by weight of glass frit.

* * * * *